US012650279B2

(12) United States Patent
Zahora et al.

(10) Patent No.: US 12,650,279 B2
(45) Date of Patent: Jun. 9, 2026

(54) GRENADE LAUNCHER

(71) Applicant: Ceska Zbrojovka a.s., Uhersky Brod (CZ)

(72) Inventors: Josef Zahora, Liberec (CZ); Vladimir Simek, Uhersky Brod (CZ)

(73) Assignee: CESKA ZBROJOVKA A.S., Uhersky Brod (CZ)

( * ) Notice: Subject to any disclaimer, the term of this patent is extended or adjusted under 35 U.S.C. 154(b) by 0 days.

(21) Appl. No.: 19/117,281

(22) PCT Filed: Sep. 13, 2023

(86) PCT No.: PCT/CZ2023/000038
§ 371 (c)(1),
(2) Date: Mar. 31, 2025

(87) PCT Pub. No.: WO2024/074161
PCT Pub. Date: Apr. 11, 2024

(65) Prior Publication Data

US 2026/0110519 A1 Apr. 23, 2026

(30) Foreign Application Priority Data

Oct. 4, 2022 (CZ) ..... CZ2022-417

(51) Int. Cl.
*F41C 27/06* (2006.01)

(52) U.S. Cl.
CPC ..... *F41C 27/06* (2013.01)

(58) Field of Classification Search
CPC ..... F41C 27/06
See application file for complete search history.

(56) References Cited

U.S. PATENT DOCUMENTS 2,397,572 A * 4/1946 Weaver ..... F41A 3/18 42/105
2,455,361 A * 12/1948 Garand ..... F41C 27/06 42/105

(Continued)

FOREIGN PATENT DOCUMENTS

WO 2013/098747 A2 7/2013

OTHER PUBLICATIONS

PCT Search Report and Written Opinion for related PCT Patent Application No. PCT/CZ2023/000038, dated Nov. 29, 2023, 9 pages.

*Primary Examiner* — Derrick R Morgan
(74) *Attorney, Agent, or Firm* — Hovey Williams LLP; Paul J. Walker

(57) ABSTRACT

A grenade launcher, comprising a barrel (10), a trigger mechanism base (3) and a breech (2) wherein the trigger mechanism base (3) is adapted to be mounted on a host rail interface (1). On the opposed sides (3) of the trigger mechanism base (3), guide rails (5, 8) are arranged for sliding mounting of the barrel (10). The host rail interface (1) is clamped between the breech (2) and the trigger mechanism base (3). The breech (2) is fitted with a cavity (11) that surrounds one of the guide rails (5). The inner wall of the cavity (11) is pressed to this guide rail (5) by a detent (4) that is insertable between this guide rail (5) and the opposed inner wall of the cavity (11) that is inclined in a wedge-like way. A pin (6) bears on this guide rail (5) from the inner side, the pin being mounted in a sliding way in a recess transversally in the breech (2) and fitted with a compression spring (7).

3 Claims, 2 Drawing Sheets

(56) References Cited

U.S. PATENT DOCUMENTS

| | | | | | |
|---|---|---|---|---|---|
| 4,019,424 | A * | 4/1977 | Reynolds | F41A 9/18 | 42/105 |
| 4,733,489 | A * | 3/1988 | Kurak | F41C 27/06 | 42/105 |
| 6,142,058 | A * | 11/2000 | Mayville | F41B 11/55 | 89/126 |
| 10,119,781 | B1 * | 11/2018 | Teetzel | F41C 27/06 | |
| 2016/0153744 | A1 * | 6/2016 | Teetzel | F41C 27/06 | 42/105 |
| 2019/0011219 | A1 * | 1/2019 | Mezynski | F41C 27/06 | |
| 2019/0162505 | A1 * | 5/2019 | Mezynski | F41C 27/00 | |
| 2022/0113098 | A1 * | 4/2022 | Berger | F41F 1/00 | |

* cited by examiner

GRENADE LAUNCHER

RELATED APPLICATIONS

This application is the National Stage of International Patent Application No. PCT/CZ2023/000038, filed Sep. 13, 2023, which is hereby incorporated herein by reference in its entirety, and which claims priority to Czech Patent Application No. PV 2022-417, filed Oct. 4, 2022, which is also incorporated herein by reference in its entirety.

TECHNICAL FIELD

The invention relates to a grenade launcher, comprising a barrel, a trigger mechanism base and a breech wherein the trigger mechanism base in adapted to be mounted on a host rail interface, and on the opposed sides of the trigger mechanism base, guide rails are arranged for sliding mounting of the barrel.

BACKGROUND ART

A grenade launcher is a light weapon designed to destroy armoured targets, living forces and military equipment found in the open terrain or in field type shelters. Grenade launchers can employ a wide range of grenades, for instance cumulative, armour-piercing, fragmentation and special types of grenades (thermobaric, smoke, lighting, incendiary, gas, etc.).

Some grenade launchers can be used either as standalone ones or as attached to an assault rifle. If such grenade launcher is used in a standalone manner, it is mounted on a grenade launcher carrier using a rail interface. The same rail interface can then be used to attach such a grenade launcher to an assault rifle.

A rail interface is generally used to mount accessories and options to weapons and constitute and adapter between the weapon and the installed accessories.

Originally, such a rail interface was mainly used to mount optical sights, but gradually, it started to be used to mount further accessories, e.g., grenade launchers as well.

The best-known and most widespread mounting system today is the originally military system developed by the American government-owned armament company Picatinny Arsenal and subsequently standardized in the U.S. military forces under the designation MIL-STD-1913 (STANAG 4694).

The introduction of such a standard facilitates procurement of various options, mounted additionally to weapons without the necessity to specify in a detailed way the interface with the use of which the accessory is to be mounted to the weapon for each item.

The MIL-STD-1913 rail interface consists of a series of transversal grooves of standard dimensions where accessories are mounted with the use of screws, quick clamps or other fixed and non-dismountable connections.

When mounted with the use of screws, an accessory is set on the MIL-STD-1913 interface of the host weapon and is secured with the use of transversal screws that compress the splice plates of the screws from one side, creating a prism, which represents the working principle of the MIL-STD-1913 interface. Rigidity of this solution depends on the length of the mounting interface. The longer the MIL-STD-1913 (STANAG 4694) interface is, the more rigid is the connection, which is important especially in the case of grenade launchers.

Mounting with the use of quick-clamping screws is similar to that with screws, but it is an assembly without the use of tools. However, to increase rigidity and to ensure proper functioning, the compression of the quick-clamping screws with respect to the prism on the clamping interface of the host weapon needs to be adjusted. Rigidity of this solution also depends on the length of the mounting interface.

It is the object of the invention to propose such a structural design of a grenade launcher that would facilitate its mounting on the host rail interface of an assault rifle or a grenade launcher carrier.

SUMMARY OF THE INVENTION

The said object is achieved with a grenade launcher, comprising a barrel, a trigger mechanism base and a breech wherein the trigger mechanism base is adapted to be mounted on a host rail interface, and on the opposed sides of the trigger mechanism base, guide rails are arranged for sliding mounting of the barrel, according to the invention the principle of which is that the host rail interface is clamped between the breech and the trigger mechanism base and the breech is fitted with a cavity that surrounds one of the guide rails and the inner wall of the cavity is pressed to this guide rail by a detent that is insertable between this guide rail and the opposed inner wall of the cavity that is inclined in a wedge-like way and a pin bears on this guide rail from the inner side, the pin being mounted in a sliding way in a recess transversally in the breech and fitted with a compression spring.

An advantage of the grenade launcher according to the invention is that it can be easily mounted on and dismounted from the host rail interface of an assault rifle or a grenade launcher carrier without the use of tools.

In a preferred embodiment, the host mounting rail interface is of the MIL-STD-1913 STANAG 4694 type.

In another preferred embodiment, the detent is pressed to the locking engagement between the guide rail and the opposed inner wall of the cavity with a wedge-like inclination by a detent spring.

BRIEF DESCRIPTION OF DRAWINGS

The invention will be described in a more detailed way with reference to a particular embodiment of the inventive grenade launcher illustrated in the attached drawings where individual figures show.

EXAMPLES OF EMBODIMENTS

Figure 1:
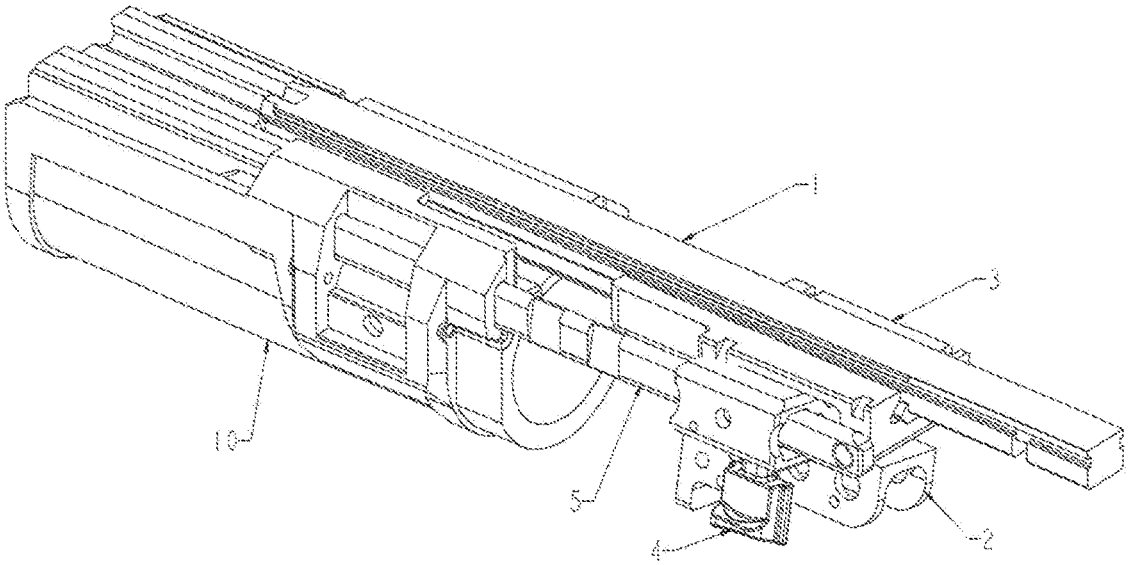
FIG. 1—a grenade launcher according to the invention, mounted on a host rail interface.
Figure 2:
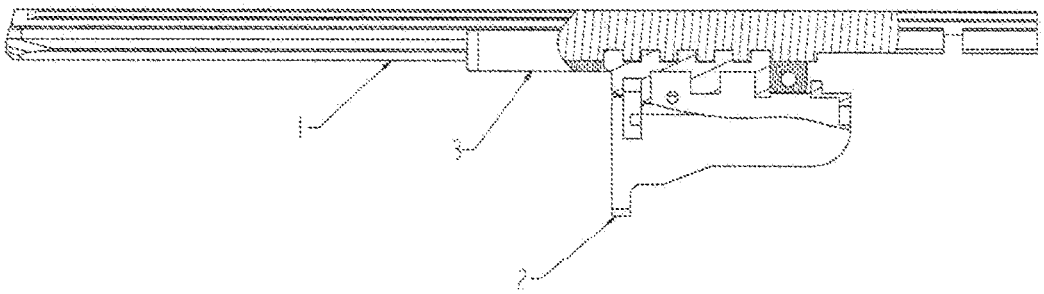
FIG. 2—a side view of the breech and the trigger mechanism base of the grenade launcher on a host rail interface.

The grenade launcher according to FIG. 1 has a barrel 10 that is mounted in a sliding way between the front and rear position on guide rails 5, 8, arranged at the opposed sides of the trigger mechanism base 3.

The trigger mechanism base 3 is adapted to be slid onto a host rail interface 1 of the MIL-STD-1913 STANAG 4694 type. This host rail interface 1 may be either part of a host weapon, e.g., an assault rifle, or a grenade launcher carrier if the grenade launcher is used in a standalone way.

Figure 3:
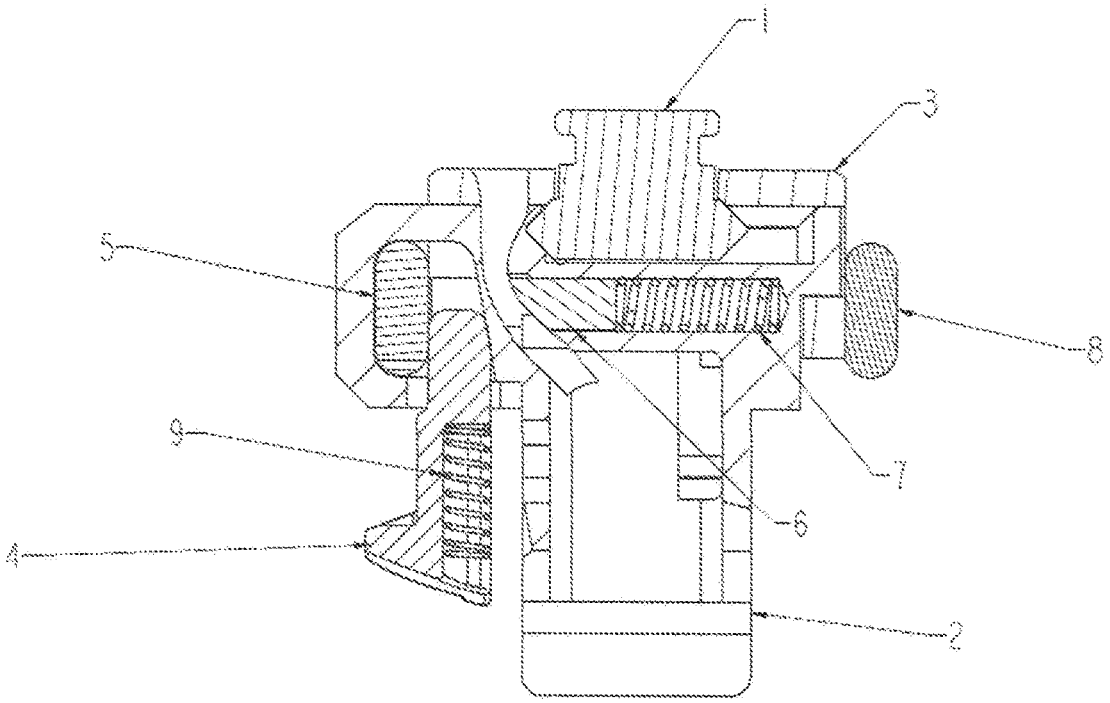
FIG. 3—a sectional view of the breech and the trigger mechanism base of the grenade launcher, locked on a host rail interface.
Figure 4:
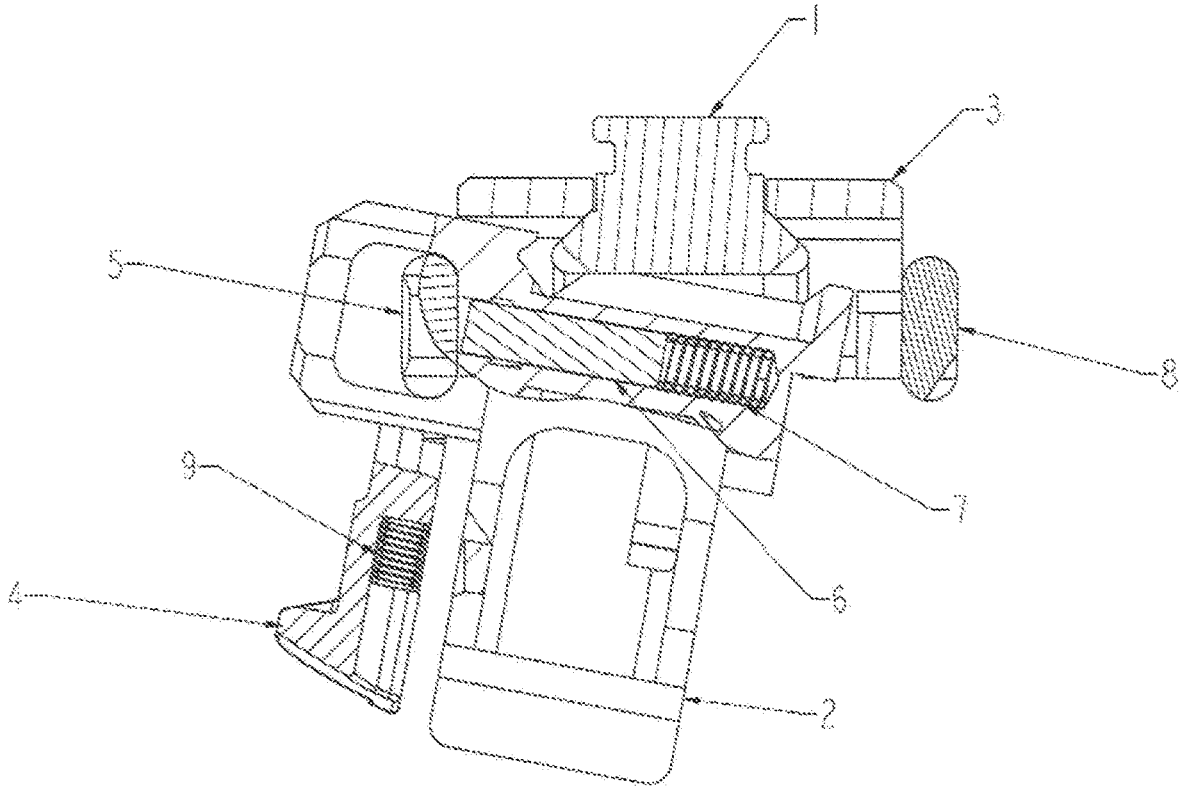
FIG. 4—the embodiment of FIG. 3 in the unlocked state.

The breech 2 is also attached to the host rail interface 1 in such a way that the host rail interface 1 is clamped between the breech 2 and the trigger mechanism base 3 (see FIGS. 3 and 4).

The breech 2 is fitted with a cavity 11 that surrounds the left guide rail 5 and the inner wall of the cavity 11 is pressed to this left guide rail 5 by a detent 4 that is inserted between the left guide rail 5 and the opposed inner wall of the cavity 11 that is inclined in a wedge-like way, forming a wedge lock.

A pin 6 that is mounted in a sliding way in a recess transversally in the breech 2 and fitted with a compression spring 7 bears on the left guide rail 5 from the inner side. The pin 6 is pressed to the left guide rail 5 by the compression spring 7 (see FIGS. 3, 4), thus pressing the breech 2 to the side and thereby the prism of the host rail interface 1 towards the trigger mechanism base 3. This way, the plays resulting from production tolerances are delimited.

The detent 4 is pressed to the locking engagement between the guide rail 5 and the opposed inner wall of the cavity 11 having a wedge-like inclination by a detent spring 9.

The grenade launcher can be disassembled from the host rail interface 1 of the host weapon or the grenade launcher carrier without the use of tools.

During the disassembly, the barrel 10 is first moved to the front position, which at the same time causes removal of the barrel 10 from the not shown collar at the bottom edge of the breech 2.

Then, the breech 2 is unlocked by pushing the detent 4 downwards against the action of the detent spring 9.

After pressing the detent 4, which extends between the left guide rail 5 and the opposed inner wall of the cavity 11 having a wedge-like inclination, the breech 2 can be tilted in the trigger mechanism base 3 to the left by approx. 45° (see FIG. 4) as seen from the shooter's view, which will simultaneously force the pin 6 against the action of the compression spring 7.

After tilting of the breech 2, the entire grenade launcher can be slid backwards or forwards along the host rail interface 1, and thus the grenade launcher can be easily removed from the host rail interface 1.

The grenade launcher is mounted on the host rail interface 1 of the host weapon or a grenade launcher carrier in the reverse order.

LIST OF REFERENCE SIGNS

1 host rail interface
2 breech
3 trigger mechanism base
4 detent
5 left guide rail
6 pin
7 compression spring
8 right guide rail
9 detent spring
10 barrel
11 cavity

The invention claimed is:

1. A grenade launcher, comprising a barrel, a trigger mechanism base and a breech wherein the trigger mechanism base is adapted to be mounted on a host rail interface, and on the opposed sides of the trigger mechanism base, guide rails are arranged for sliding mounting of the barrel, the breech and the trigger mechanism base are configured to clamp the host rail interface, and the breech is fitted with a cavity that surrounds one of the guide rails and an inner wall of the cavity is pressed to the guide rail by a detent that is insertable between the guide rail and an opposed inner wall of the cavity, the opposed inner wall of the cavity is inclined in a wedge-like way and a pin bears on the guide rail from the inner side, the pin being mounted in a sliding way in a recess transversally in the breech, and the pin fitted with a compression spring.

2. The grenade launcher according to claim 1, characterized in that the host rail interface is a picatinny rail interface.

3. The grenade launcher according to claim 1 characterized in that the detent is pressed into locking engagement between the guide rail and the opposed inner wall of the cavity by the wedge-like inclination by a detent spring.

* * * * *